US007098804B2

(12) United States Patent
Tringali et al.

(10) Patent No.: US 7,098,804 B2
(45) Date of Patent: Aug. 29, 2006

(54) APPARATUS FOR BROADCASTING A WARNING SIGNAL

(75) Inventors: Salvatore Tringali, Avondale Heights (AU); Keith Manson, Christchurch (NZ)

(73) Assignee: Emergency Warning Systems Pty Ltd, Essendon (AU)

( * ) Notice: Subject to any disclaimer, the term of this patent is extended or adjusted under 35 U.S.C. 154(b) by 0 days.

(21) Appl. No.: 10/481,220

(22) PCT Filed: Jun. 18, 2002

(86) PCT No.: PCT/AU02/00796

§ 371 (c)(1),
(2), (4) Date: May 28, 2004

(87) PCT Pub. No.: WO02/103653

PCT Pub. Date: Dec. 27, 2002

(65) Prior Publication Data

US 2004/0201494 A1 Oct. 14, 2004

(30) Foreign Application Priority Data

Jun. 19, 2001 (AU) ..... PR5775

(51) Int. Cl.
*G08G 1/00* (2006.01)

(52) U.S. Cl. ..... 340/902; 340/903; 340/933; 340/988

(58) Field of Classification Search ..... 340/901, 340/902, 903, 904, 905, 906, 988, 539.1, 340/539.19, 539.21, 539.23, 644, 933, 990; 455/42, 68, 70, 404
See application file for complete search history.

(56) References Cited

U.S. PATENT DOCUMENTS

| | | | | |
|---|---|---|---|---|
| 3,710,313 | A | 1/1973 | Kimball et al. | 340/33 |
| 3,784,970 | A | 1/1974 | Simpkin | 340/33 |
| 4,238,778 | A | 12/1980 | Ohsumi | 340/33 |
| 4,296,496 | A | 10/1981 | Sadler | 455/1 |
| 4,403,208 | A | 9/1983 | Hodgson et al. | 340/33 |
| 5,572,201 | A | 11/1996 | Graham et al. | 340/902 |
| 5,635,921 | A | 6/1997 | Maxwell et al. | 340/902 |
| 5,757,284 | A * | 5/1998 | Trizzino et al. | 340/902 |
| 5,808,560 | A * | 9/1998 | Mulanax | 340/902 |
| 5,889,475 | A * | 3/1999 | Klosinski et al. | 340/902 |
| 6,087,961 | A * | 7/2000 | Markow | 340/902 |
| 6,326,903 | B1 * | 12/2001 | Gross et al. | 340/988 |

* cited by examiner

*Primary Examiner*—Hung Nguyen
(74) *Attorney, Agent, or Firm*—Bromberg & Sunstein LLP

(57) ABSTRACT

There is disclosed vehicle mounted apparatus for broadcasting a warning signal on a radio channel to thereby warn of the vehicle's approach. The apparatus includes a transmitter for broadcasting a warning signal on a radio channel, and a controller for controlling the strength of the broadcast warning signal on the basis of a signal strength of a normal signal on the radio channel to thereby control a broadcast range of the warning signal.

12 Claims, 1 Drawing Sheet

APPARATUS FOR BROADCASTING A WARNING SIGNAL

The present application claims priority from International Application No. PCT/AU02/00796, filed 18 Jun. 2002 which claims priority from Australian Patent Application No. PR5775, filed 19 Jun. 2001. Both of the above applications are hereby incorporated herein by reference.

FIELD OF THE INVENTION

The present invention relates to apparatus and a method for enabling an emergency vehicle to broadcast a warning signal.

BACKGROUND TO THE INVENTION

Currently emergency vehicles operate a warning siren in order to warn people that the emergency vehicle is approaching so that those persons can take such action as is necessary to get out of the path of the emergency vehicle. Recent car design has improved sound deadening to isolate passengers from other noise. This makes it more difficult for drivers and/or passengers to hear a siren. Further, there is now wide spread use of sound systems in motor vehicles and a tendency for persons to listen to their sound systems at high volume levels which can make it difficult for them to hear a warning siren. Hence, audible warning devices used by emergency vehicles have become less effective.

U.S. Pat. No. 4,296,496 proposes a radio warning device for broadcasting a warning signal which can be received by radios in vehicles in the immediate area.

U.S. Pat. No. 5,889,475 proposes a system in which a radio signal transmitted by a moving vehicle is used to activate an AM/FM transmitter located at an intersection. Once activated, the transmitter broadcasts a warning signal which can be received by a vehicle's radio.

An inherent problem with such systems is that the warning signal will be received by radio receivers of people who do not need to receive the warning signal. While this cannot be avoided entirely, it would be advantageous to provide apparatus which aims to minimize the extent to which people who do not need to receive the warning signal are inconvenienced.

SUMMARY OF THE INVENTION

Accordingly, the invention provides vehicle mounted apparatus for broadcasting a warning signal on a radio channel to thereby warn of the vehicle's approach, the apparatus including:

a transmitter for broadcasting a warning signal on a radio channel; and a controller for controlling the strength of the broadcast warning signal on the basis of a signal strength of a normal signal on the radio channel to thereby control a broadcast range of said warning signal.

Preferably, said controller also controls said warning signal in accordance with the speed of a vehicle.

Preferably, said apparatus further includes a memory associated with said controller for storing a signal strength of the normal radio channel.

Preferably, said apparatus further includes a receiver for receiving and measuring said normal signal strength of said radio channel and storing said signal strength in said memory, and wherein said controller controls the strength of the warning signal on the basis of the signal strength currently stored in said memory.

Preferably, said receiver periodically monitors said signal strength to thereby update said signal strength for said radio channel stored in said memory.

Preferably, said apparatus broadcasts warning signals on a plurality of radio channels.

Preferably, said apparatus broadcasts said warning signals concurrently.

Alternatively, said controller broadcasts said warning signals on each of said radio channels in turn.

Preferably, where said transmitter broadcasts a warning signal on each of said radio channels in turn, said receiver monitors the signal strength on a channel which is currently not being broadcast upon.

Alternatively, said receiver monitors said signal strength during pauses in transmission of said warning signals.

Preferably, said transmitter has a directional antenna oriented in the direction of travel of said vehicle for transmitting said warning signal when said radio channel is in the frequency range 80 to 120 megahertz.

The invention also provides a method of broadcasting a warning signal including:

broadcasting a warning signal on a radio channel; and controlling the strength of the warning signal on the basis of the signal strength of the radio channel to thereby control a broadcast range of said warning signal.

Further features of the invention will become apparent from the following description of the preferred embodiment of the invention.

BRIEF DESCRIPTION OF THE DRAWINGS

A preferred embodiment of the invention will now be described in relation to the accompanying drawing, FIG. 1, which is a block diagram showing the components of the preferred embodiment.

DESCRIPTION OF THE PREFERRED EMBODIMENT

Figure 1:
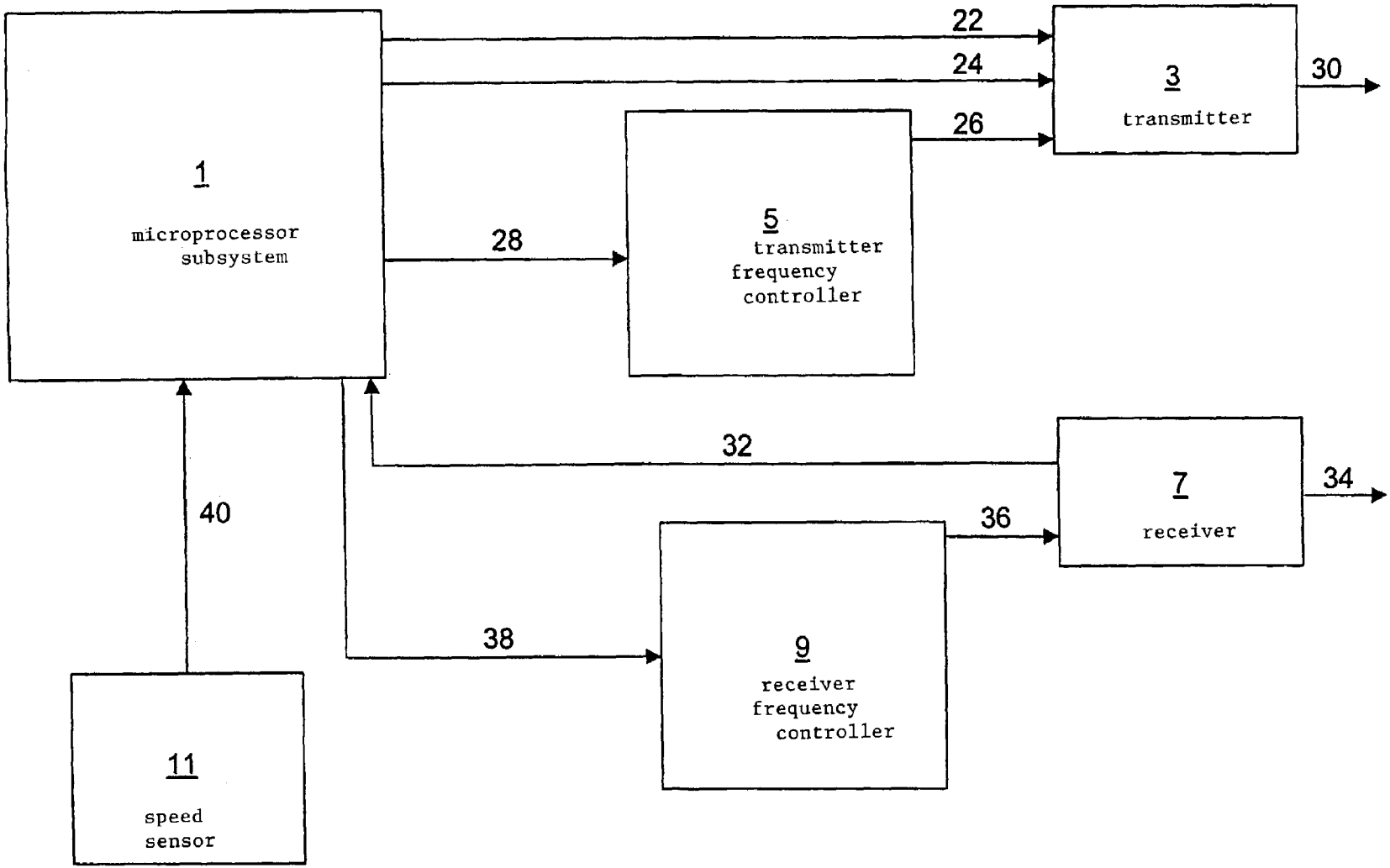

FIG. 1 is a schematic block diagram of the vehicle mounted apparatus of the preferred embodiment. In the preferred embodiment, the apparatus is mounted on an emergency vehicle. The apparatus is designed to broadcast a warning signal on radio channels which may be being received by vehicles which could potentially block the path of the emergency vehicle. That is, vehicles which are in the immediate vicinity of the emergency vehicle. Thus, the apparatus is configured to broadcast a warning signal on radio channels operated by commercial or public broadcasters.

In order to broadcast successfully on these channels, it is necessary for the apparatus to broadcast at a higher signal strength than the signal strength being received by the radios of the vehicles in the emergency vehicle's path. However, if the broadcast signal is too strong it will interfere with radios which do not need to receive the warning signal. Accordingly, there is a need to balance the need to warn people with the inconvenience which this may cause. In the preferred embodiment the range of the broadcast emergency signal is controlled so that it does not unduly inconvenience persons with radios in the vicinity of the emergency vehicle.

Accordingly and referring to FIG. 1, in the preferred embodiment, transmitter 3 which generates a warning signal 30 which is broadcast on a transmitter antenna (not shown).

An output power control signal 22 is generated by microprocessor sub-system 1 and sent to the transmitter in order to control the power level of the broadcast warning signal.

In the preferred embodiment, the microprocessor sub-system 1 is configured to generate output power control signals which aim to control the transmitter to ensure that the warning signal is audible 150 meters from the emergency vehicle. However, the output power control signal 22 may be controlled in accordance with a number of factors which will be discussed further below. The microprocessor sub-system 1 also generates the audio signal to be transmitted and transmits this via audio signal 24 to transmitter 3 which converts the audio signal into the transmitted warning signal.

In the preferred embodiment the transmitted warning signal is a pre-recorded message warning persons that the emergency vehicle is approaching. The microprocessor sub-system is configured to allow the pre-recorded message to be changed from time to time. A typical message would be "Emergency. Emergency. Please move to the side of the road". It will be apparent to persons skilled in the art that to simplify the system, the pre-recorded message could be replaced a similar tone to a normal emergency warning.

It will be appreciated that in most cities there are a large number of radio frequencies in use by public and commercial broadcasts and hence, it is necessary to broadcast a warning signal on each of these channels. Accordingly, the microprocessor sub-system 1 has stored within the sub-system memory, a radio station database listing the transmission frequencies of all the radio stations in the region where the emergency vehicle is operating. The database can be updated if the emergency vehicle or the apparatus is moved to a different area, if radio frequencies change, or if new frequencies are added.

In the preferred embodiment, the transmitter 3 is controlled to broadcast the emergency signal on each channel in turn. The microprocessor sub-system generates a series of control signals 28 corresponding to the respective radio channel in order to control transmitter frequency controller 5 which provides radio frequency control and transmits RF signal 26 to transmitter 3 to control the frequency on which the transmitter 3 transmits. The antenna is typically a pair of antennas: an AM antenna and an FM antenna. The FM antenna is chosen to be able to broadcast in the frequency rang 80–120 MHz and is typically a directional antenna which is designed to broadcast predominantly in the direction in which the vehicle is travelling with some margin to either side. Thus, the warning signal can be transmitted to those vehicles immediately in front of the emergency vehicle but not those which the emergency vehicle has passed.

Persons skilled in the art will appreciate that the warning signal may be transmitted in a number of other ways. For example, there may be a plurality of transmitters corresponding to each radio channel.

In the preferred embodiment, in order to determine the appropriate output power control signal, a receiver 7 monitors and measures the incoming signal strength of the normal signal on each radio channel. The measured signal strength is forwarded by signal 32 to the microprocessor sub-system 1. The received signal strength is then stored in the microprocessor's memory so that it can be used as the basis for calculating the output power.

The output power $P_o$ is then calculated using the following equation:

$$P_o=FR+O;$$

where F is a programmable factor related to the desired ratio of transmit signal strength to received signal strength (and hence, the broadcast range of the transmitter), R is the received signal strength, and O is a fixed offset (e.g. 6 dB).

By use of the term programmable factor, it will be appreciated that the factor can be entered into the memory of the microprocessor sub-system 1.

To achieve the programmable factor F of the preferred embodiment, a calibration was performed. In the preferred embodiment the maximum transmitter power was assigned a full scale value of 140 units. Similarly, the maximum received signal strength was assigned a value of 500 units. Persons skilled in the art will appreciate that the actual values will depend on the transmitter or receiver being used, and persons skilled in the art will be able to select appropriate transmitters and receivers (In the preferred embodiment a 7 Watt transmitter is used).

A signal strength meter was then used to measure the strength of the normal signal on a radio channel while noting the corresponding reading obtained by the receiver of the apparatus. The transmitter output strength was then adjusted (at a different frequency) to obtain the same signal strength as the distance at which coverage is required and noting the output power of the transmitter to obtain this signal strength. The factor F is then the output power signal divided by the received signal strength. In the apparatus of the preferred embodiment a factor of 0.2 was found to be suitable.

If the vehicle is moving, the signal strength is also controlled in accordance with the speed of the vehicle. Thus, a stronger signal is broadcast if the vehicle is moving faster because the emergency vehicle and will close the distance between itself and any vehicles in front of it more quickly.

This is represented by the following equation:

$$P_s=P_oF_s\times S$$

where Fs is another programmable factor and S is the vehicle speed.

$F_s$ can be obtained by performing the above calibration at different distances. $F_s$ is then: (transmitter setting at distance1–transmitter strength at distance2)/distance1–distance2), where distance 2 is closer to the transmitter.

The vehicle speed is obtained from vehicle speed sensor 11 which is transmitted to the microprocessor 1 as signal 40. The vehicle speed sensor can be the vehicle's speedometer some other suitable sensor.

The microprocessor sub-system 1 also controls the receiver frequency by signal 38 so that the receiver frequency control 9 causes the receiver 7 by means of signal 36 to scan the various radio channels to obtain a signal strength for each channel.

In order to obtain the received signal strength of each channel, the receiver checks the signal strength while there is no transmission on the radio channel by transmitter 3. While there is no transmission the apparatus scans constantly and updates the stored radio channel signal strength for each radio channel as the vehicle moves along so that the signal strength is representative of the vehicle's current location. Thus, pauses are provided in the transmission of the warning signal in which the signal strength can be measured. In an alternative embodiment the apparatus scans the radio channel in the period leading up to the alarm being initiated and then use the signal strengths from the period before the alarm has been initiated to control the output power.

While less preferred, it is also possible that typical power levels for a region may be stored in a memory of a microprocessor system and that this information could be correlated with position information (for example, obtained by a GPS) to thereby enable the apparatus to broadcast at an appropriate signal level.

These and other modifications will be apparent to persons skilled in the art and the invention should be interpreted as falling within the scope of the invention described herein

The invention claimed is:

1. Vehicle mounted apparatus for broadcasting a warning signal on a radio channel to thereby warn of the vehicle's approach, the apparatus comprising:

a transmitter for broadcasting a warning signal on a radio channel;

a receiver for receiving and measuring a signal strength of a normal signal of said radio channel; and a controller for controlling a strength of the broadcast warning signal based on the measured signal strength of the normal signal of said radio channel to thereby control a broadcast range of said warning signal, wherein said receiver stores said signal strength in said memory, and wherein said controller controls the strength of the warning signal on the basis of the signal strength currently stored in said memory.

2. Vehicle mounted apparatus as claimed in claim 1, wherein said controller also controls said warning signal in accordance with a speed of a vehicle.

3. Vehicle mounted apparatus as claimed in claim 1, wherein said apparatus includes a memory associated with said controller for storing the measured signal strength of the radio channel.

4. Vehicle mounted apparatus as claimed in claim 1, wherein said receiver periodically monitors said signal strength to thereby update said signal strength for said radio channel stored in said memory.

5. Vehicle mounted apparatus as claimed in claim 4, wherein said receiver monitors said signal strength during pauses in transmission of said warning signal.

6. Vehicle mounted apparatus as claimed in claim 1, wherein said apparatus is configured to broadcast warning signals on a plurality of radio channels.

7. Vehicle mounted apparatus as claimed in claim 6, wherein said apparatus is configured to broadcast said warning signals concurrently.

8. Vehicle mounted apparatus as claimed in claim 6, wherein said apparatus is configured to broadcast said warning signals on each of said radio channels in turn.

9. Vehicle mounted apparatus as claimed in claim 8, wherein said receiver monitors the signal strength on a channel which is currently not being broadcast upon.

10. Vehicle mounted apparatus as claimed in claim 1, wherein said transmitter has a directional antenna oriented in the direction of travel of said vehicle for transmitting said warning signal when said radio channel is in the frequency range 80 to 120 megahertz.

11. A method of broadcasting a warning signal comprising:

receiving and measuring a signal strength of a normal signal of a radio channel;

broadcasting a warning signal on said radio channel using a transmitter;

controlling a strength of the warning signal based on the measured signal strength of the normal signal of said radio channel to thereby control a broadcast range of said warning signal, and storing said measured signal strength in a memory and controlling the strength of the warning signal based on the currently stored signal strength.

12. A method as claimed in claim 11, further comprising periodically monitoring said signal strength to thereby update the stored signal strength.

* * * * *